US007682228B2

(12) United States Patent
Gunst et al.

(10) Patent No.: US 7,682,228 B2
(45) Date of Patent: Mar. 23, 2010

(54) COIN INTAKE MECHANISM FOR SELF-SERVICE CASH REDEMPTION MACHINE AND METHOD

(75) Inventors: Robert E. Gunst, Neosho, WI (US); Joseph P. Hanus, Watertown, WI (US); Thomas P. Adams, Oconomowoc, WI (US)

(73) Assignee: Talaris Inc., Watertown, WI (US)

( * ) Notice: Subject to any disclaimer, the term of this patent is extended or adjusted under 35 U.S.C. 154(b) by 1036 days.

(21) Appl. No.: 11/005,251

(22) Filed: Dec. 6, 2004

(65) Prior Publication Data

US 2006/0144670 A1 Jul. 6, 2006

(51) Int. Cl.
*G07D 3/00* (2006.01)

(52) U.S. Cl. ..... 453/11; 453/56

(58) Field of Classification Search ..... 194/342, 194/344, 550.01, 550.2, 396, 443; 453/18, 453/56, 11

See application file for complete search history.

(56) References Cited

U.S. PATENT DOCUMENTS

| | | | | |
|---|---|---|---|---|
| 3,258,099 | A * | 6/1966 | Hertzschuch et al. | 194/206 |
| 3,709,145 | A * | 1/1973 | Williamson | 101/66 |
| 3,965,912 | A | 6/1976 | Gross | |
| 4,383,540 | A | 5/1983 | De Meyer et al. | |
| 5,040,657 | A | 8/1991 | Gunn et al. | |
| 5,398,798 | A * | 3/1995 | Ericson | 194/202 |
| 5,531,640 | A * | 7/1996 | Inoue | 453/17 |
| 5,564,546 | A | 10/1996 | Molbak et al. | |
| 5,620,079 | A | 4/1997 | Molbak | |
| 5,799,767 | A | 9/1998 | Molbak | |
| 5,989,118 | A | 11/1999 | Chiba et al. | |
| 6,053,807 | A | 4/2000 | Metzger et al. | |
| 6,109,427 | A * | 8/2000 | Hosch et al. | 198/835 |
| 6,484,863 | B1 | 11/2002 | Molbak | |
| 6,494,776 | B1 | 12/2002 | Molbak | |
| 6,554,694 | B2 * | 4/2003 | Umeda et al. | 453/56 |
| 6,736,251 | B2 | 5/2004 | Molbak | |
| 6,788,603 | B2 | 9/2004 | Derner et al. | |
| 2002/0189920 | A1 | 12/2002 | Molbak | |
| 2004/0124062 | A1 | 7/2004 | Molbak | |

FOREIGN PATENT DOCUMENTS

| | | |
|---|---|---|
| WO | WO 2004/023404 A1 | 9/2002 |

* cited by examiner

*Primary Examiner*—Patrick H Mackey
*Assistant Examiner*—Michael C McCullough
(74) *Attorney, Agent, or Firm*—Boyle Fredrickson, S.C.

(57) ABSTRACT

A self-service change redemption machine (10) has a coin hopper area (41) for receiving batches of mixed coinage and a powered mechanism (43) for transporting them to an intake opening (44) into the machine (10) for sorting, counting and directing coins into a plurality of coin receptacles. The transport mechanism has a pivotable cover (46, 46*a*) for preventing access to a portion of the feed path leading into the machine (10) and, if the cover (46, 46*a*) is lifted, the powered mechanism (43) will be stopped. The mechanism (43, 46) is designed to prevent jamming of the coins in the hopper area (41) or along the feed path (45).

20 Claims, 9 Drawing Sheets

COIN INTAKE MECHANISM FOR SELF-SERVICE CASH REDEMPTION MACHINE AND METHOD

TECHNICAL FIELD

The present invention relates to self-service cash redemption machines and a method in which a substantial batch of unsorted coinage is fed in bulk into the machine and is processed while providing the user with a voucher or a form of credit.

DESCRIPTION OF THE BACKGROUND ART

The prior art is best seen in cash redemption machines in which coins are sorted and counted to determine a total value. The user is issued a voucher for an amount related to the total value. Examples of machines for carrying out these transactions are shown and described in U.S. Pat. Nos. 6,736,251, 6,494,776, 6,484,863 and earlier related patents cited therein.

Various other types of machines for both receiving coins and providing the consumer with a credit have been known, including ATM machines and large cash handling machines for gaming operations. An example is shown and described in U.S. Pat. No. 6,788,603.

A problem in machines that are to be used by consumers without special training is the deposit of bulk coin in the tray or other intake mechanism of the self-service cash redemption machine. As the coins are fed into the machine they tend to jam or clog in the intake opening, which is usually smaller in volume-handling capability than the intake hopper or tray.

In the prior art, intake mechanisms for coin sorting machines have been largely unpowered. There have been, however, a few examples of power feeding devices, examples of which are shown and described in U.S. Pat. No. 6,053,807, U.S. Pat. No. 5,989,118, U.S. Pat. No. 5,040,657, and U.S. Pat. No. 3,965,912. These have often been large devices for large machines. In smaller machines the intake mechanism have been unpowered and subject to jamming.

There remains a need for a self-service coin recycling machine, with an improved coin feeding mechanism in which coins do not usually become jammed in the intake opening. The intake mechanism should be easy to operate, and should provide a mechanism to prevent the user from reaching into the coin flow while a feed motor is operating.

SUMMARY OF THE INVENTION

The invention relates to a method and a machine for receiving a batch of coinage from a user in a coin hopper, and then moving the coins along an inclined coin path to an intake opening into a body of the cash redemption machine. A cover is disposed over a portion of the inclined coin path to prevent access to the intake opening in the machine and to prevent access to coins in a vicinity of the intake opening.

In further aspects of the invention, the cover is preferably pivotable at one end closest to the intake opening and is interfaced with the feeding mechanism, so that if there is any attempt to lift the cover the feeding mechanism will be stopped. The cover is also preferably a solid, transparent member for viewing the coins as they are fed along the inclined coin path. The cover can also be a made of a wire grid.

In still further aspects of the invention, the cover is disposed at an acute angle to the feed path and has an angled edge for receiving the coins such that an opening formed between the cover and a transport mechanism becomes wider across the path of the coins to allow larger coins to migrate to one side of the path while accepting smaller coins on an opposite side. This is just one of the many features of the invention that prevents jamming in the intake mechanism, which is a primary problem with such devices in the prior art.

Other objects and advantages of the invention, besides those described above, will be apparent to those of ordinary skill in the art from the description of the preferred embodiments which follows. In the description, reference is made to the accompanying drawings, which form a part hereof, and which illustrate examples of the invention.

DETAILED DESCRIPTION OF THE PREFERRED EMBODIMENTS

Figure 1:
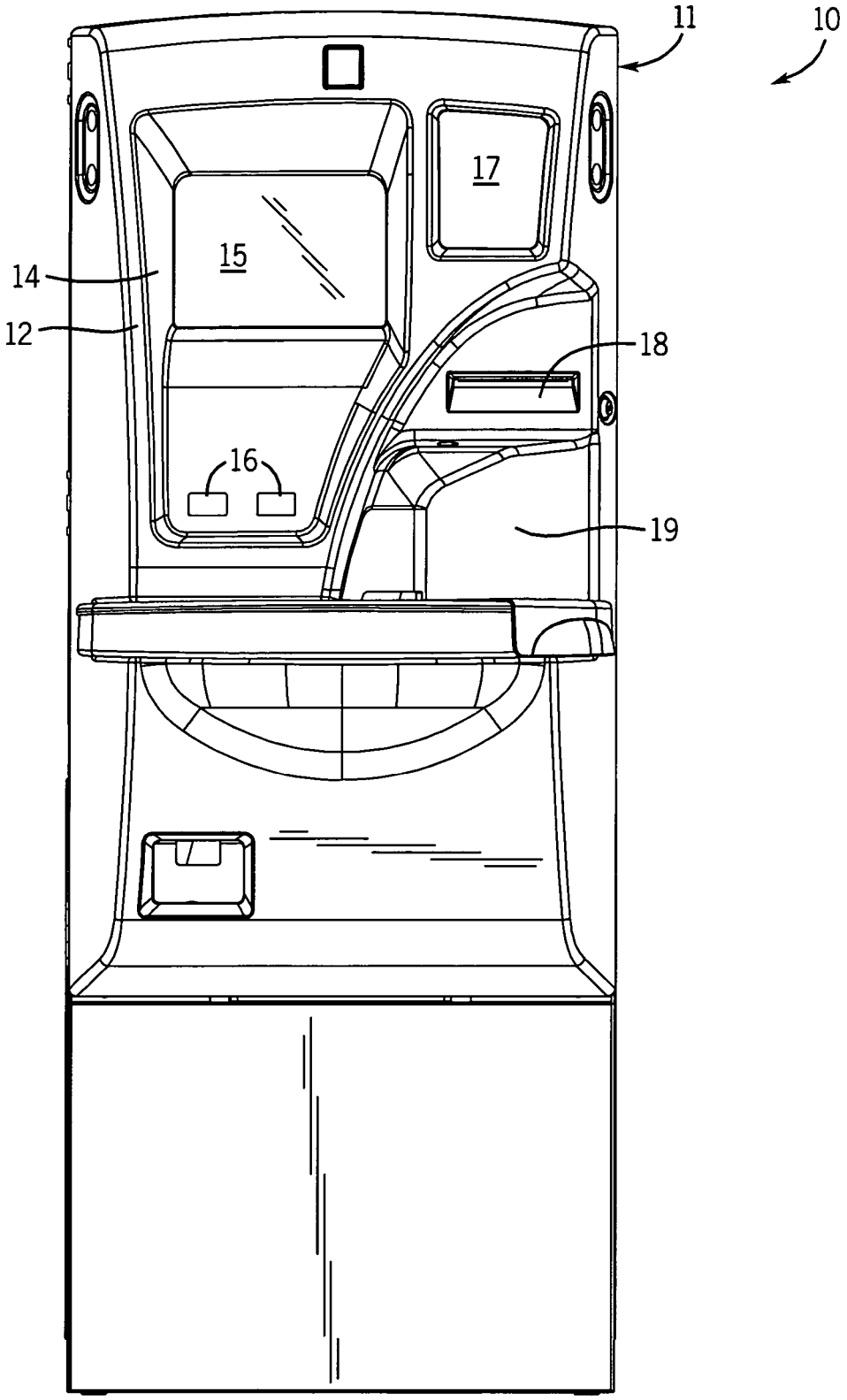
FIG. 1 is a front view in elevation of a first embodiment of a self-service cash redemption machine according to the present invention.

FIG. 1 shows a self-service cash redemption machine 10 in which the present invention is incorporated. The machine is housed in a cabinet enclosure 11 having a front door 12. The door 12 has an opening 14 for viewing a visual display screen 15. Below this screen 15 are two buttons 16, identified as "A" and "B", for allowing the user to enter selections of items on the screen 15. To the right of the display is an area for an advertising display 17 and below that is a printout slot 18 for receiving a receipt or other printable matter that exits a printer installed inside the enclosure 11. Just below the printer output slot 18 is a coin intake area 19 for receiving coins into the machine 10.

Figure 2:
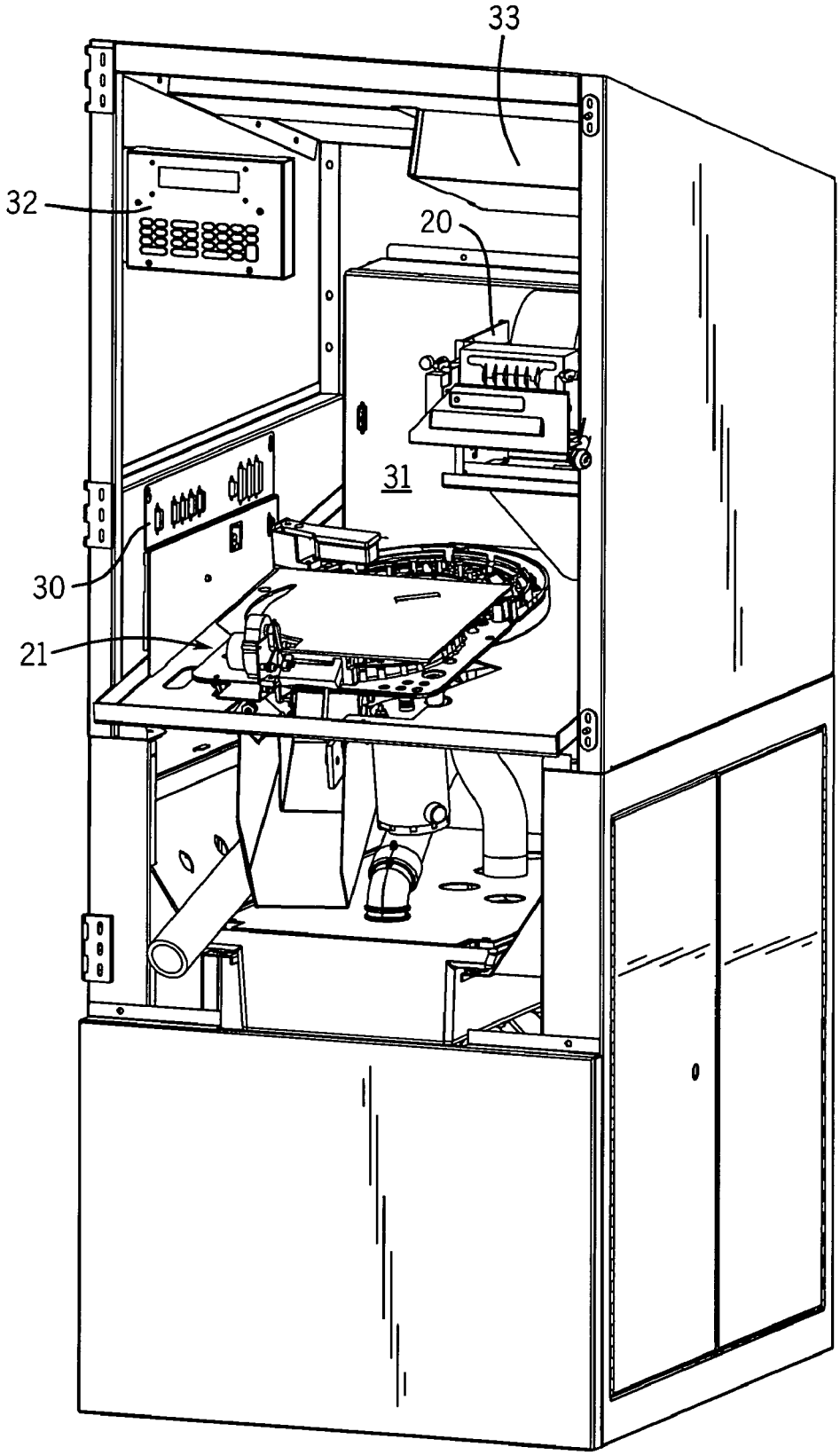
FIG. 2 is a frontal perspective view of the machine of FIG. 1 with front panels opened for viewing an interior of the machine.

FIG. 2 shows the machine with the front door 12 removed. The printer 20 is now visible, along with a coin processing assembly 21 having a sorting and counting mechanism for receiving a batch of unsorted coinage from a user and for sorting coins into a plurality of denominations.

The printer 20 operates under the control of a controller 30 seen in FIG. 2. This is a microcomputerized controller of a type disclosed in Adams et al., U.S. Pat. No. 5,992,602, issued Nov. 30, 1999, and Zwieg et al., U.S. Pat. No. 6,640,956, issued Nov. 4, 2003. It includes one or more microelectronic CPU's, a program memory, a data memory and a program that is executed by a main CPU for controlling the operations of the machine. The controller 30 is also connected to the I/O devices such as the printer 20, the count sensors on the sorting and counting mechanism and others to be described herein. The printer 20 can print out a voucher or receipt representing the amount of coinage fed into the coin processing assembly 21 and counted by the controller 30 through sensing devices on the sorting mechanism of the coin processing assembly 21. The user can present this voucher or receipt in payment for merchandise, or could, where permitted, redeem it for cash in the form of notes and a small amount of change less than one dollar. An output device for issuing a card with a pre-paid credit amount, like a phone card, could also be used in place of the printer.

The coin processing assembly 21 is commercially available in the assignee's Mach® 6 line of dual disc coin sorters. As is well known in the art, the coins are deposited on a queueing disc and transferred to a sorting plate where they fall through slots sized for different denominations. From there, the coins are routed into coin receptacles, such as coin bags or removable bins. For details of the construction and operation of dual disc sorters, the disclosures in Adams et al, U.S. Pat. Nos. 5,295,899 and 5,525,104 and Adams et al., U.S. Pat. No. 5,992,602, issued Nov. 30, 1999, Zwieg et al., U.S. Pat. No. 6,640,956, issued Nov. 4, 2003, and Zwieg et al., U.S. patent application Ser. No. 10/896,472, filed Jul. 27, 2004, which are incorporated herein by reference.

Figure 3:
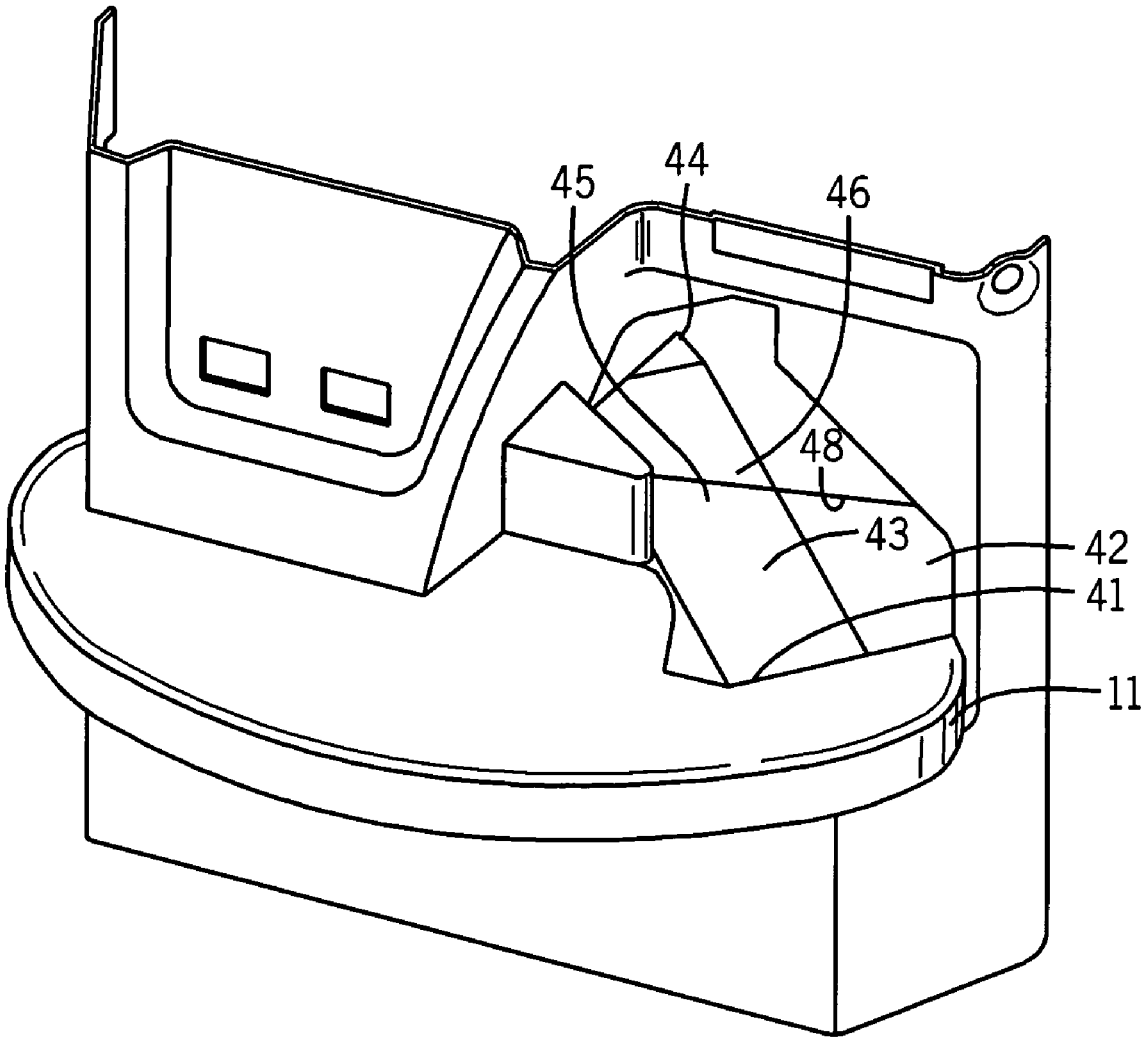
FIG. 3 is a detail perspective view of a coin intake area of the machine of FIG. 1.

FIG. 3 shows an enlarged detail view of an improved coin intake mechanism 40. The coins are deposited in a funnel-shaped hopper area 41 with side walls 42 leading to a front end of an inclined conveyor 43. The conveyor 43 is inclined at an angle of about twenty degrees to complete the funnel shape around the coin intake area together with the conveyor side walls 42 and a hopper back wall (not seen in FIG. 3). The conveyor 43 extends upward towards and through an intake opening 44 in the wall of the machine cabinet 11. Coins are fed along a feed path 45 corresponding to a longitudinal direction of the conveyor 43. Above a portion of the conveyor 43 is a solid, transparent cover 46 that blocks access to a portion of the inclined coin path 45 and to the intake opening 44 to prevent access to the intake opening 44 and to prevent access to coins in a vicinity of the intake opening 44 while the conveyor is running. If the cover 46 is lifted to resolve a problem, such as a foreign object in the feed path, the conveyor 43 will be stopped.

Figure 4:
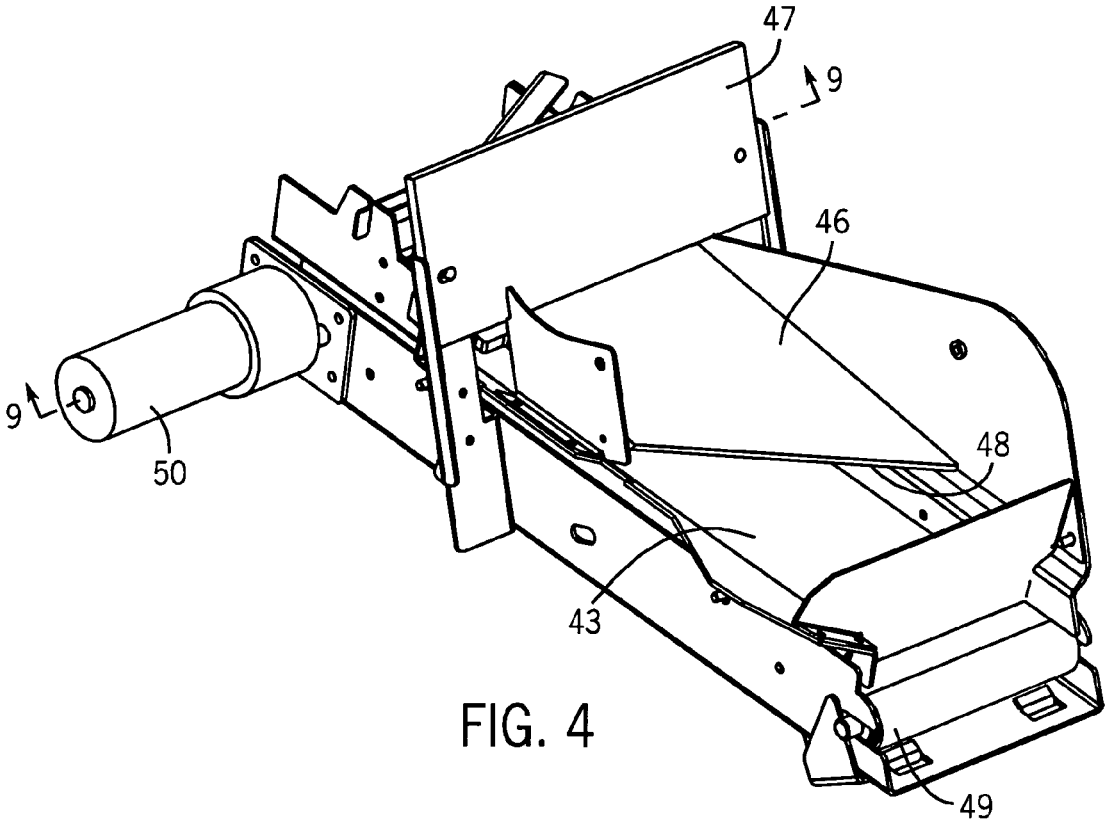
FIG. 4 is a detail perspective view of a coin intake subassembly in a first operating position with other parts of the machine removed for a better view.
Figure 5:
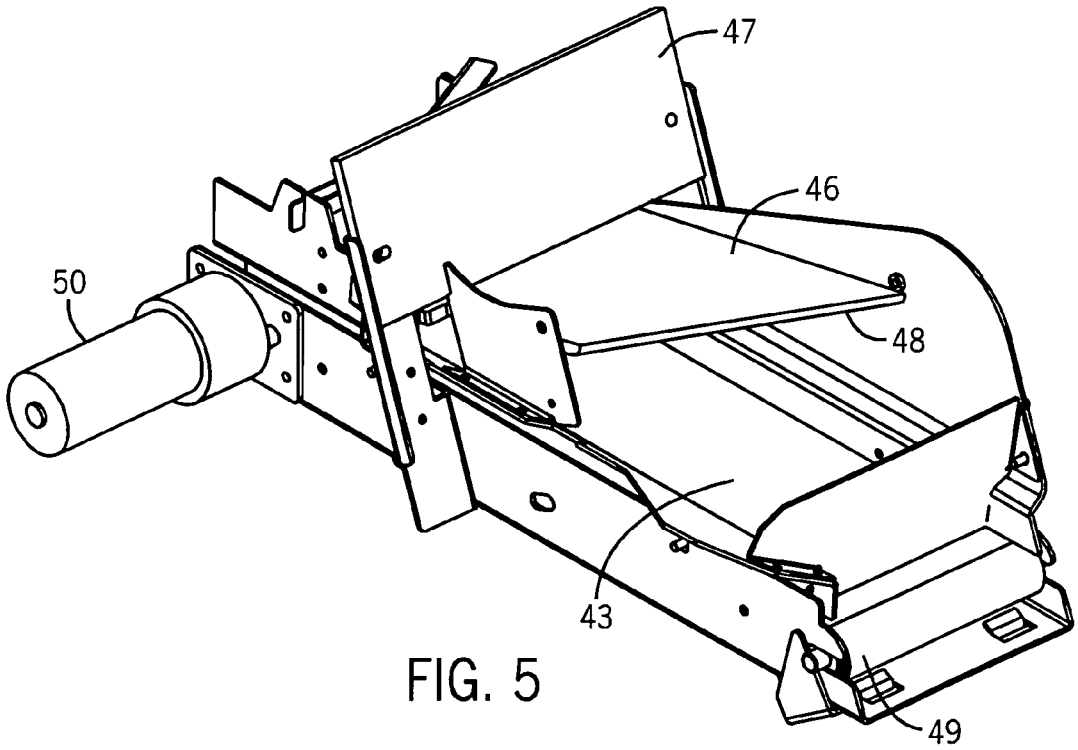
FIG. 5 is a detail perspective view of the coin intake subassembly in a second operating position.

Referring next to FIGS. 4 and 5, the cover 46 is a solid, transparent, planar member that is pivotable at one end facing towards a body of the machine 10 and opposite an end for receiving the coins. The machine 10 has a transparent window member 47 positioned above the intake opening 44 to allow a view into an interior of the cash redemption machine 10. The cover 46 is disposed in a plane that converges toward the coin hopper area 41 at an acute angle as seen in FIG. 4. The cover 46 has an edge 48 facing towards the coin hopper area 41, the edge 48 being disposed at an acute angle relative to the direction of travel of the coins so as to provide a lateral opening across the coin path 45 that becomes wider as the angled edge 48 recedes toward an intake opening 44 into a body of the cash redemption machine 10. This will cause smaller coins to fit under any part of the cover 46, but a larger coin on edge will move over to a wider opening before sliding under the cover 46. This creates movement within a body of coins and relieves jamming that might otherwise occur when the coins block the opening between the conveyor 43 and the cover 46.

Figure 9:
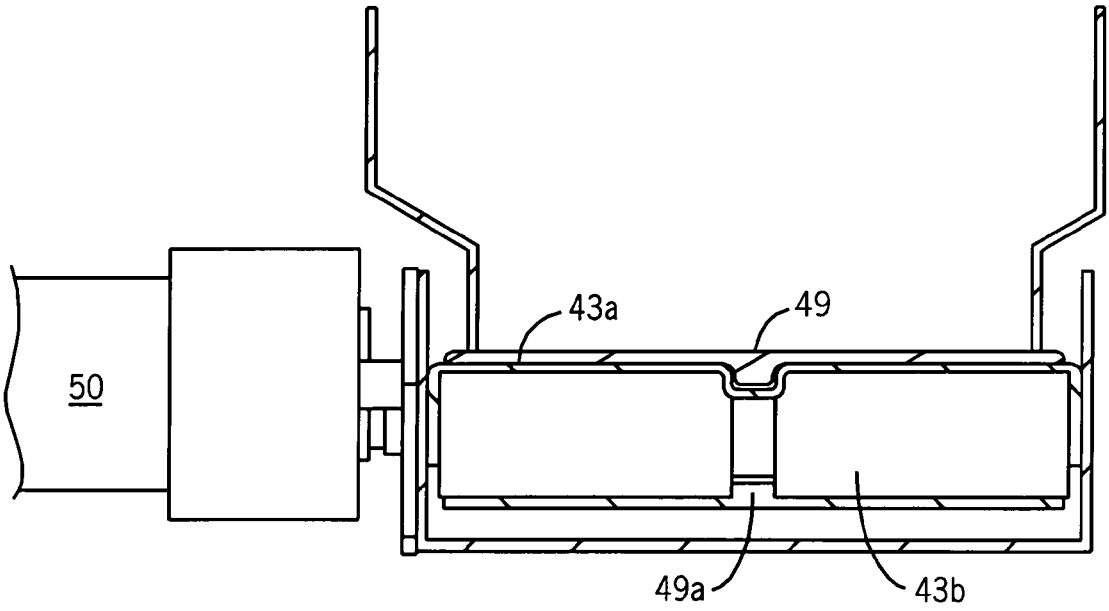
FIG. 9 is a detail sectional view taken in the plane indicated by line 9-9 in FIG. 4.

The conveyor 43 has a looped belt 49 that is driven through a roller 43*b* by a motor 50 inside the machine cabinet 11, with the other end of the conveyor belt 49 looping around a second roller at the hopper end. As seen in more detail in FIG. 9, the roller 43*b* has a mid-section circumferential groove which receives a rib 49*a* on the underside of the belt 49. The rib 49*a* and the belt 49 are typically formed of a resilient, elastic material. Also seen in FIG. 9 is a platen 43*a*. The rib 49*a* is formed along the full length of the looped belt 49 to provide lateral stability to the belts as the belt is moved by the rollers 43*b*. In section, the rib has a slight taper along each side, the width of the rib 49*a* being slightly narrower where it contacts the roller 43*b* and the platen 43*a*.

Figure 6:
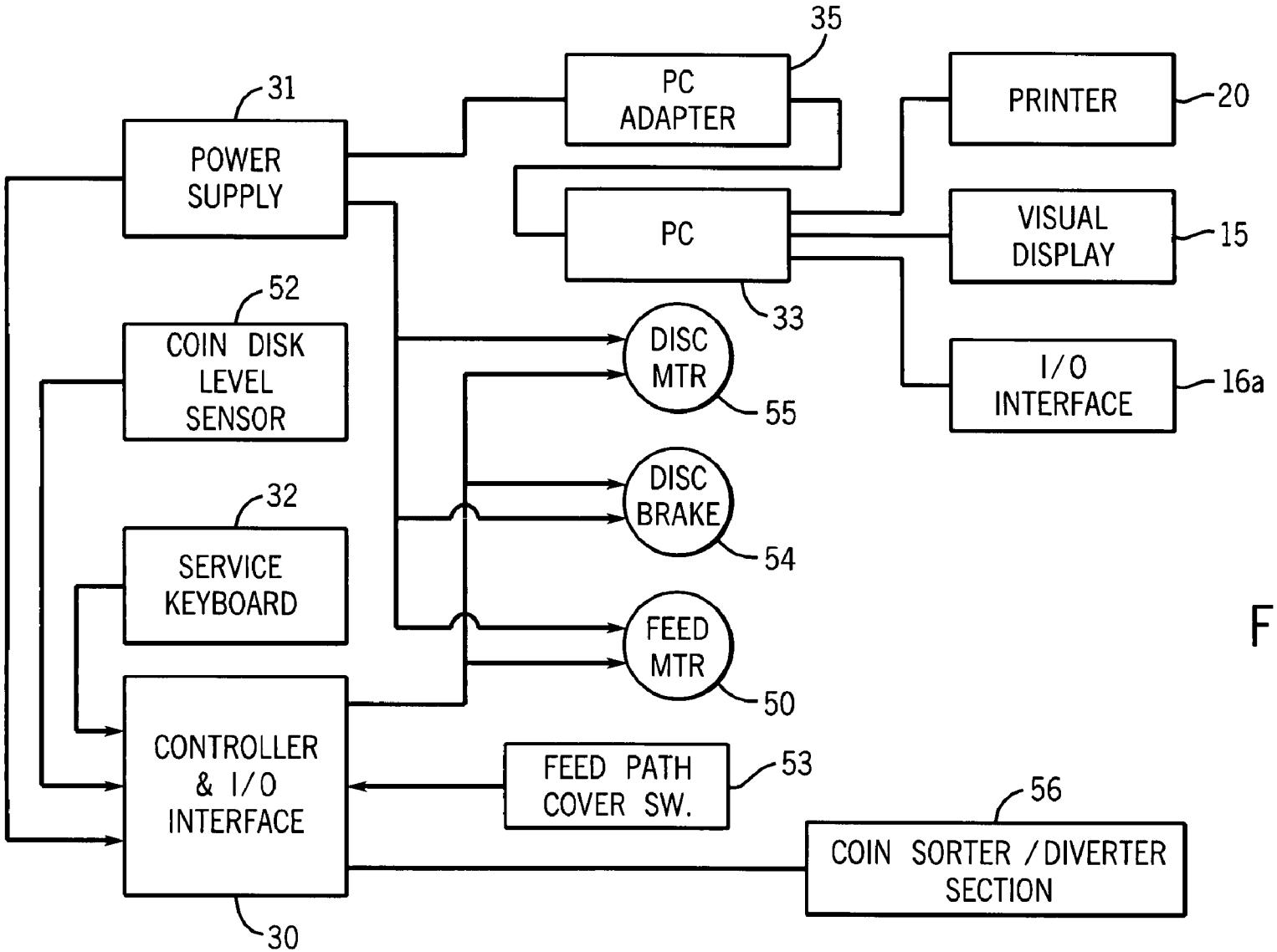
FIG. 6 is a block diagram of a controller portion of the cash redemption machine along with sensors and motors in the machine.

FIG. 6 is a diagram of the electronic controls portion of the machine 10. The controller 30 is connected through an I/O interface to various input and output devices. The controller 30 is supplied with power by a power supply 31. A service keyboard 32 is provided inside the machine for entering commands and data when the door 12 is open. A coin sorting disk level sensor 52 shown diagrammatically in FIG. 6, senses the level of coins on a sorting mechanism in the coin processing assembly 21, and generates a signal to the controller to start the conveyor 43, subject to the cover 46 being in the proper position.

The controller 50 also connects to output devices such as the disc motor 55 and disc brake 54 for the coin sorter and to the conveyor feed motor 50. The controller 30 also receives input signals from a feed path cover sensing switch 53. The pivotable cover member 46 is connected to the switch 53, which will sense the movement of the cover 46 and signal the controller 30 that the conveyor 43 should be stopped (or not started). The controller 30 is connected to control the feed motor 50 in response to these signals. The controller 50 also connects to motors and sensors in a coin sorter/diverter section 56 as more particularly described and illustrated in Zwieg et al., U.S. patent application Ser. No. 10/896,472, filed Jul. 27, 2004.

The larger I/O devices which are seen on the exterior of the machine, such as the printer 20, the visual display 15 and the "A" or "B" buttons 16 (through I/O interface 16*a*) are controlled by a personal computer (PC) 33 which is housed in the cabinet 11 of the machine 10 as seen in FIG. 2. The personal computer 33 receives power from the power supply 31 through a PC power adapter 35 of a type well known in the art.

Figure 7:
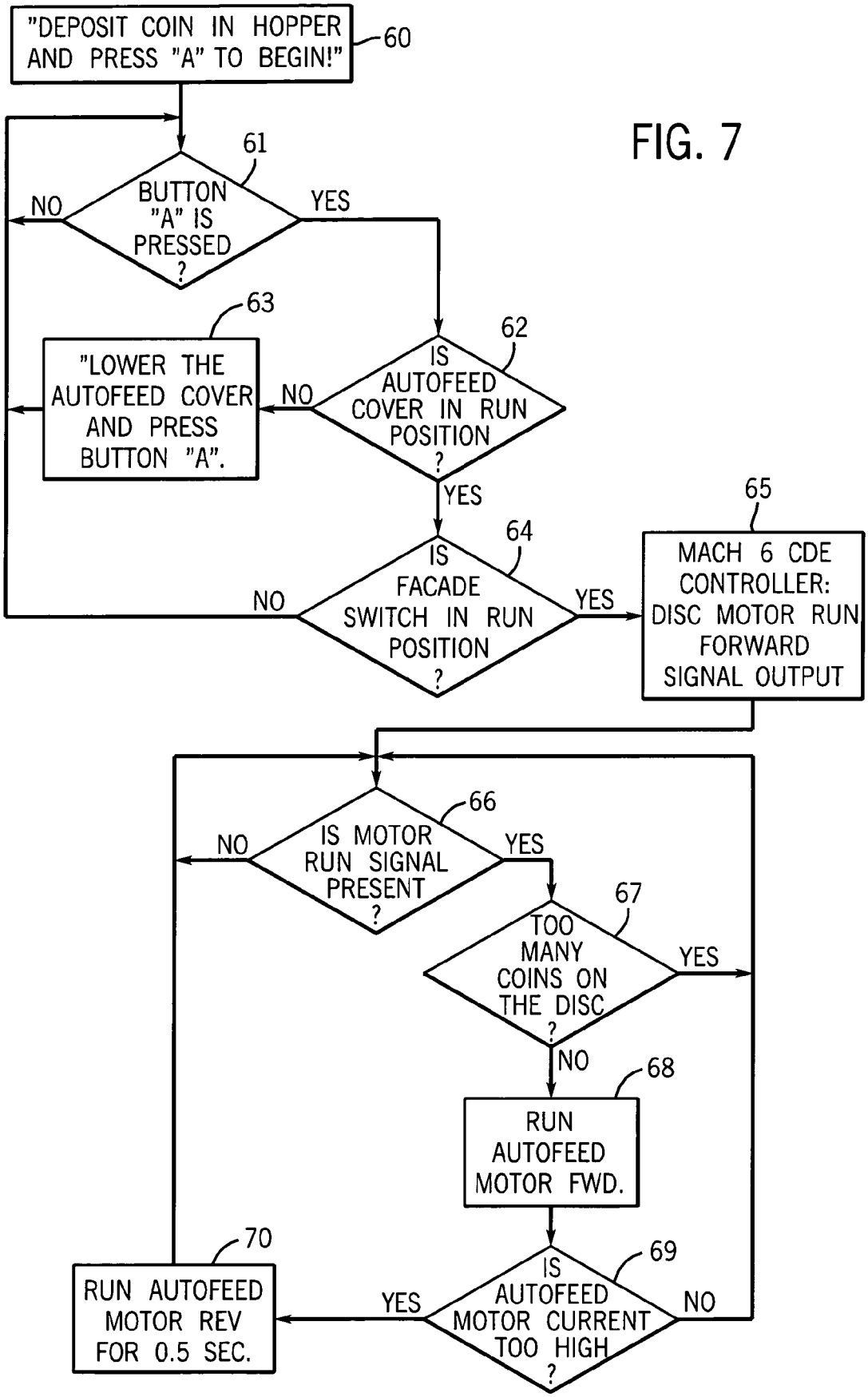
FIG. 7 is a flow chart of operation of a controller for controlling the operation of the coin intake subassembly of FIG. 4.

As seen in FIG. 7, the user sees a message displayed on the display 15 to deposit coins in the hopper and depress the "A" button 16, as represented by display block 60. As represented by decision block 61, the personal computer 33 is waiting is a delay loop for the user to start an operating sequence by operating the "A" 16. When the button has been pushed, as represented by the "Yes" result, the personal computer 33 senses the position of the sensing switch 53 as represented by decision block 62, and if the cover 46 has not been lifted as represented by the "Yes" result, a second check is made to see that the front door is properly closed for operation of the machine 10, as represented by decision block 64. If the cover 46 has been lifted, as represented by the "No" result from executing decision block 62, then a further message is displayed to the user to lower the cover 46 and press button "A" as represented by display block 63. If the cover has not been lifted but the door switch is not in the proper position, the routine will loop back to decision block 61, until the door is properly closed.

Assuming that the disc motor 55 has been started as represented by process block 65, then a check is made for a RUN signal representing the running of the sorter, and if the sorter has started up satisfactorily, the result for executing the test in decision block 66 is a "Yes" result. The program sequence then proceeds to decision block 67, to check for that the level of coins on the sorting disk is OK. If the result from that check is "Yes," then the conveyor motor 50 is started as represented by process block 68. Blocks 69 and 70 represent a check for proper current and operation of the conveyor motor 50.

The user deposits coins in the coin hopper area 41 where they are placed on the conveyor 43 to be fed into the machine 10 and processed. If more coins are to be entered, button "A" is pressed again. If no more coins are to be entered and a voucher or receipt is to be printed, then a display is shown on the visual display to ask the user to wait for the printing of receipt, the receipt is printed and the visual display displays a message advising the user to take the receipt.

Figure 8A:
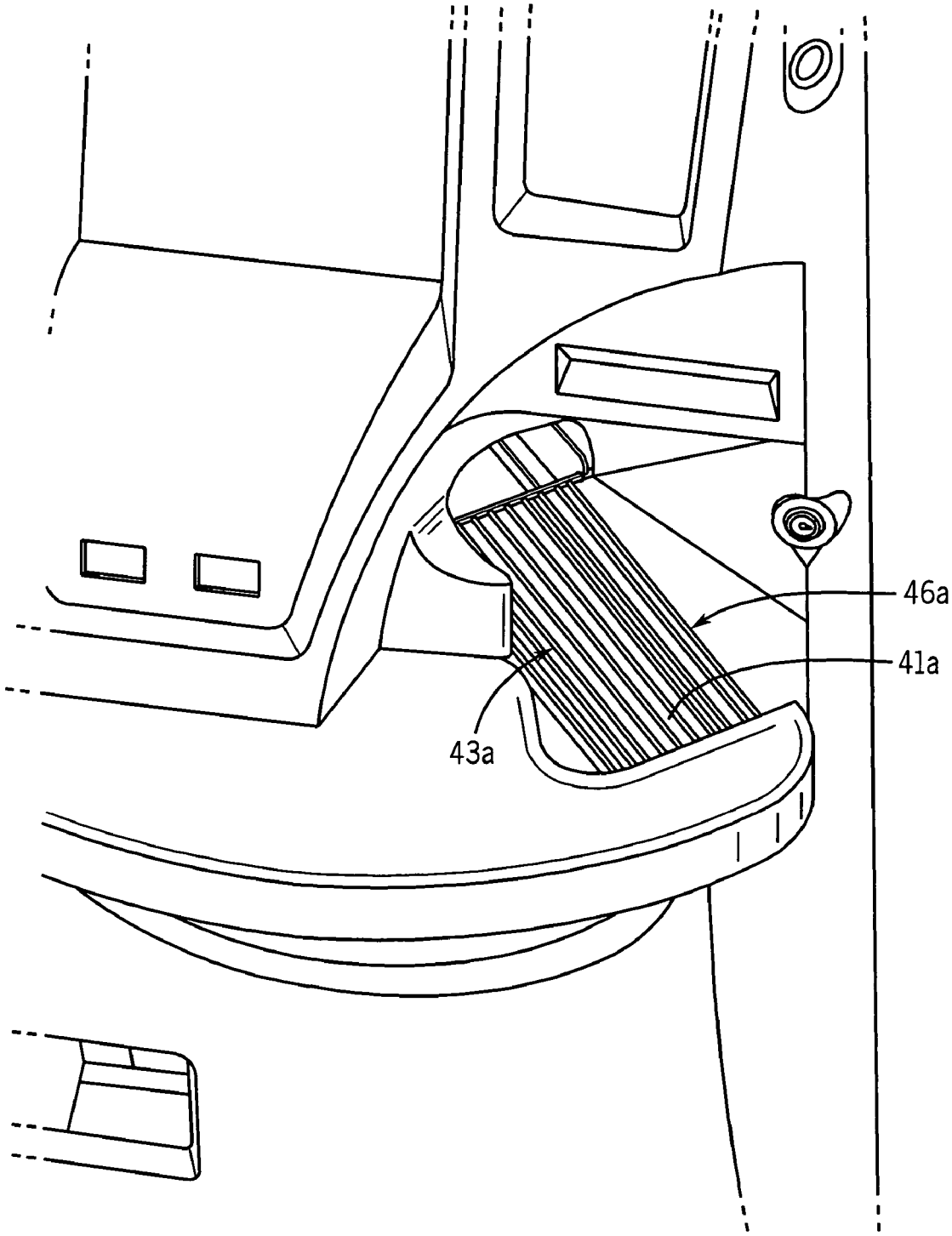
FIGS. 8*a* ad 8*b* show the coin intake assembly of FIG. 4 with a modification to the cover member.
Figure 8B:
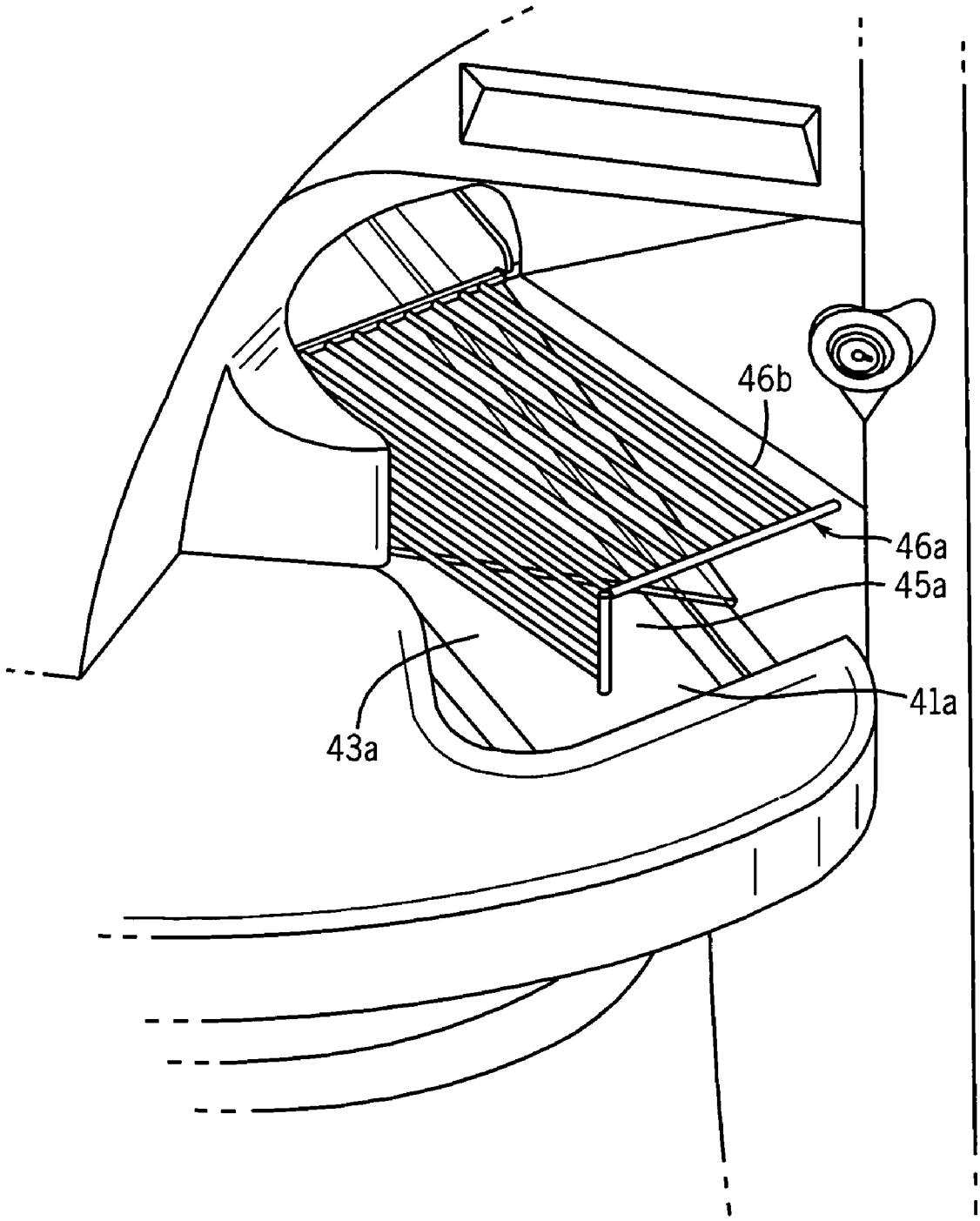

FIGS. 8*a* and 8*b* show an alternative construction 46*a* for the cover. FIG. 8*a* shows the cover 46*a* in the operating position, while FIG. 8*b* shows the cover 46*a* when lifted to access the coin feed path 45*a*. In this embodiment, the cover 46*a* is not a solid transparent member but a wire grid that allows coins to fall through to the conveyor 43*a*, but blocks other objects from entering the conveyor 43*a* from above, while also allowing visibility of the coin feed path 45*a*. The wire grid member 46*a* is hinged and pivoted as described for the solid transparent member 46. In the example, the wire elements 46*b* of the cover 46*a* run parallel to the direction of coin feeding. In still other versions, the grid member 46*a* could include transverse elements running across the longitudinal elements 46*b*. And, the grid member 46*a* can be made of materials other than metal. In all of these variations, the operation of the sensing switch in stopping the feed motor when the cover is lifted would be the same as described above for the solid transparent cover 46.

From this description, it should now be apparent how the invention provides a coin handling machine with an improved coin intake mechanism that will resist jamming and allow resolution of problems in the coin feed path while the feed conveyor is stopped. The machine is easy and convenient to service, maintain and to remove the accumulated coinage. The machine is capable of dispensing a voucher, or a credit to the customer.

It will be apparent to those of ordinary skill in the art that other modifications might be made to these embodiments without departing from the spirit and scope of the invention, which are defined by the following claims.

We claim:

1. A coin intake mechanism for a cash redemption machine for receiving a batch of coinage from a user, for totaling a value for the batch of coinage and for dispensing a voucher or a form of credit to the user, the coin intake mechanism comprising:

an open coin hopper for receiving a batch of coins which are put into the machine by the user;

an inclined path disposed laterally to one side of the open coin hopper and having a lower end for receiving coins from the open coin hopper and an opposite, higher end entering into an intake opening into a body of a cash redemption machine; and a motorized feeding mechanism for moving the coins along the inclined path to the intake opening; and a cover disposed laterally to one side of the coin hopper area and extending lengthwise over a portion of the inclined coin path to prevent access to the intake opening in the machine and to prevent access to coins in a vicinity of the intake opening, the cover being spaced from the inclined path to allow coins to be fed therebetween as the coins are received from the coin hopper; and wherein the cover is pivotable at one end that is disposed opposite an end for receiving the coins; and further comprising a sensor for sensing pivoting of the cover from a position preventing access to the intake opening to a lifted position; and wherein the motorized feeding mechanism is responsive to the sensor sensing the lifting of the cover, for stopping the movement of coins toward the intake opening.

2. The coin intake mechanism of claim 1, wherein the coin path is inclined at about twenty degrees from horizontal.

3. The coin intake mechanism of claim 1, wherein the cover is provided by a grid member.

4. The coin intake mechanism of claim 1, wherein the cover is a planar member that is pivotable at an end facing towards a body of the machine and opposite an end for receiving the coins.

5. The coin intake mechanism of claim 4, wherein the cover is solid and transparent.

6. The coin intake mechanism of claim 5, wherein the intake opening into a body of the machine has a transparent window member positioned above the intake opening to allow a view into an interior of the cash redemption machine.

7. The coin intake mechanism of claim 5, wherein the cover is disposed above the inclined coin path and wherein the cover is disposed in a plane that converges toward the coin hopper area at an acute angle.

8. The coin intake mechanism of claim 7, wherein the cover has an edge facing towards the coin intake area, the edge being disposed at an acute angle relative to the direction of travel of the coins so as to provide a lateral opening across the coin path that becomes wider as the angled edge recedes toward an intake opening into a body of the cash redemption machine.

9. The coin intake mechanism of claim 1, further comprising a plurality of sloped surfaces for directing the coins into the intake area.

10. The coin intake mechanism of claim 1, further comprising a first means for sensing placement of coins in the coin hopper area; and second means responsive to said first means, for starting the transport of coins towards the intake opening.

11. The coin intake mechanism of claim 1, wherein the sensor includes a sensing switch that is electrically connected in a circuit with the motorized feeding mechanism.

12. The coin intake mechanism of claim 1, wherein the motorized feeding mechanism includes a conveyor belt running on rollers, the conveyor belt having a longitudinal rib running along an underside and running in groove in the rollers to assist lateral stability of the conveyor belt.

13. A cash redemption machine for receiving a batch of coinage from a user, for totaling a value for the batch of coinage and for dispensing a voucher or a form of credit to the user, the cash redemption machine having a coin counting mechanism and having a coin intake mechanism for feeding coins to the coin counting mechanism, in which the coin intake mechanism further comprises:

an open coin hopper area for receiving a batch of unsorted coins which are put into the machine by the user;

a motorized feeding mechanism having a portion in the open coin hopper area for receiving the batch of coins in the coin hopper area and for conveying the coins through an intake opening into a body of the cash redemption machine;

wherein the coins are conveyed upwardly along an inclined coin path; and a cover disposed laterally outside of the open coin hopper area and spaced above a lengthwise portion of the inclined path to prevent access to the intake opening and to prevent access to coins in a vicinity of the intake opening, while allowing coins to pass to the intake opening;

wherein the cover is pivotable at one end that is disposed opposite an end for receiving the coins; and further comprising a sensor for sensing pivoting of the cover from a position preventing access to the intake opening to a lifted position; and wherein the motorized feeding mechanism is responsive to the sensor sensing the lifting of the cover, for stopping the transport of coins toward the intake opening.

14. The cash redemption machine of claim 13, wherein the cover is a planar member that is pivotable at an end facing towards a body of the machine and opposite an end for receiving the coins.

15. The cash redemption machine of claim 14, wherein the cover is transparent.

16. The cash redemption machine of claim 15, wherein the intake opening into a body of the machine has a transparent window member positioned above the intake opening to allow a view into an interior of the cash redemption machine.

17. The cash redemption machine of claim 15, wherein the cover is disposed above the inclined coin path and wherein cover is disposed in a plane that converges toward the coin intake area at an acute angle.

18. The cash redemption machine of claim 17, wherein the cover has an edge facing towards the coin intake area, the edge being disposed at an acute angle relative to the direction of travel of the coins so as to provide a lateral opening across the coin path that becomes wider as the angled edge recedes toward an intake opening into a body of the cash redemption machine.

19. A method for receiving a batch of coinage from a user, for totaling a value for the batch of coinage and for dispensing a voucher or a form of credit to the user, the method further comprising:

receiving a batch of coins in an open coin hopper area;

conveying the coins from the open coin hopper area through an intake opening into a body of a voucher dispensing machine;

wherein the coins are moved upwardly along an inclined coin path prior to entering the intake opening; and blocking access by the user to a portion of the inclined coin path that lies laterally outside the coin hopper area and leads to the intake opening to prevent access to the intake opening and to prevent access by the user to coins in a vicinity of the intake opening;

sensing an attempt by the user to access to the portion of the inclined coin path that is blocked; and stopping movement of coins along the inclined coin path until the attempt to access is terminated.

20. The method of claim 19, further comprising sensing the placement of coins in the coin hopper area; and after the placement of coins in the coin hopper area, and after checking for an attempt to access the portion of the inclined coin path that is blocked, starting conveying of the coins along the inclined coin feeding path.

* * * * *